US006316886B1

(12) United States Patent
Luger et al.

(10) Patent No.: US 6,316,886 B1
(45) Date of Patent: Nov. 13, 2001

(54) METHOD AND DEVICE FOR CONTROLLING THE OPERATIONAL PERFORMANCE OF GAS DISCHARGE LAMPS

(75) Inventors: Siegfried Luger; Alfred Tröstl, both of Dornbrin (AT)

(73) Assignee: Tridonic Bauelemente GmbH, Dornbirn (AT)

( * ) Notice: Subject to any disclaimer, the term of this patent is extended or adjusted under 35 U.S.C. 154(b) by 0 days.

(21) Appl. No.: 09/387,847

(22) Filed: Sep. 1, 1999

Related U.S. Application Data

(63) Continuation of application No. PCT/EP98/00773, filed on Feb. 11, 1998.

(30) Foreign Application Priority Data

Mar. 4, 1997 (DE) ..... 197 08 783

(51) Int. Cl.[7] ..... G05F 1/00

(52) U.S. Cl. ..... 315/307; 315/291; 315/DIG. 4; 315/DIG. 7

(58) Field of Search ..... 315/307, 200 R, 315/206, 209 R, 224, 225, 276, 283, 291, DIG. 4, DIG. 7

(56) References Cited

U.S. PATENT DOCUMENTS 4,698,554 * 10/1987 Stupp et al. ..... 315/307
4,958,108 * 9/1990 Jorgensen ..... 315/307
5,066,894 * 11/1991 Klier ..... 315/224
5,381,076 * 1/1995 Nerone ..... 315/DIG. 7
5,600,211 * 2/1997 Luger ..... 315/307
5,900,701 * 5/1999 Guhilot et al. ..... 315/209 R
6,051,940 * 4/2000 Arun ..... 315/DIG. 4
6,060,843 * 5/2000 Primisser et al. ..... 315/291

FOREIGN PATENT DOCUMENTS

4018127A1 12/1991 (DE) .
4412510A1 10/1994 (DE) .
0605052A1 7/1994 (EP) .
0774885A1 5/1997 (EP) .
0796036A2 9/1997 (EP) .

* cited by examiner

*Primary Examiner*—Haissa Philogene
*Assistant Examiner*—Thuy Vinh Tran
(74) *Attorney, Agent, or Firm*—Fitzpatrick, Cella, Harper & Scinto

(57) ABSTRACT

Method and device for controlling the operational performance of at least one gas discharge lamp (10). The control is effected with the aid of a controller (1) the proportional component of which is set in dependence upon an externally applied desired value (SOLL) of an operational parameter of the gas discharge lamp (10), whereby for low brightness desired values the proportional component of the controller (1) is set high, and for great brightness desired values of the gas discharge lamp (10) is set low. In this way it is possible to reliably fire the gas discharge lamp (10) even at low brightness values, without the appearance of a light flash, and at the same time to avoid instabilities in the case of high brightness values of the gas discharge lamp (10).

12 Claims, 4 Drawing Sheets

METHOD AND DEVICE FOR CONTROLLING THE OPERATIONAL PERFORMANCE OF GAS DISCHARGE LAMPS

CROSS REFERENCE TO RELATED APPLICATIONS

This is a continuation of co-pending International Application No. PCT/EP98/00773, filed Feb. 11, 1998.

BACKGROUND OF THE INVENTION

1. Field of the Invention

The present invention relates to a method for controlling the operational performance of gas discharge lamps in accordance with the preamble of claim 1 and also to a device for operating gas discharge lamps, in particular an electronic ballast, in accordance with the preamble of claim 5.

2. Description of the Related Art

FIG. 4 shows a known device for operating gas discharge lamps. This device, termed an electronic ballast, firstly comprises a rectifier arrangement 4 which converts an a.c. supply voltage into a rectified intermediate-circuit voltage which is fed to an inverter 5. The inverter 5 as a rule has two switches which are connected in series between a positive supply voltage and earth and which are activated alternately. The connection point between the two alternately activated switches, which are usually formed by MOS field-effect transistors, is connected to a load circuit which in the main contains a series-resonant circuit with a coil 6 and a capacitor 7 and also at least one gas discharge lamp 10. The gas discharge lamp 10 is connected to the series-resonant circuit by way of a coupling capacitor 8.

As a result of alternately switching the two switches of the inverter 5 on and off, the rectified intermediate-circuit voltage delivered by the rectifier 4 is converted into a high-frequency, switched-mode alternating voltage which is supplied by the inverter 5 to the series-resonant circuit. The gas discharge lamp 10 is fired in that the frequency of the alternating voltage delivered by the inverter 5 is shifted into the proximity of the resonant frequency of the series-resonant circuit having the coil 6 and the capacitor 7. In this case, a voltage overshoot occurs in the voltage applied to the capacitor 7 that results in the gas discharge lamp 10 being fired. In order to extend the life of the gas discharge lamp, moreover in FIG. 4 a filament-heating transformer 9A–C is provided, the primary winding 9A of which transformer is connected to the series-resonant circuit and is connected substantially in parallel with the gas discharge lamp 10 and the secondary windings 9B and 9C of which transformer are each connected in parallel with one of the two lamp filaments of the gas discharge lamp 10. The filament-heating transformer 9A–C is used to preheat the lamp filaments of the gas discharge lamp 10, with the filament or heating voltage having a frequency which lies clearly below or above the resonant frequency. In this way, a situation is avoided where the gas discharge lamp 10 fires with cold lamp filaments, whereby the life of the gas discharge lamp 10 can be extended. It is also possible to connect a heating capacitor, as an alternative to the filament-heating transformer 9A–C, in parallel with the gas discharge lamp 10. The use of a filament-heating transformer with secondary windings 9B and 9C connected to the lamp filaments of the gas discharge lamp 10 does, however, have the advantage that it is still possible to supply energy to the lamp filaments even after the gas discharge lamp 10 has been fired.

The series-resonant circuit, having the coil 6 and the capacitor 7, and also the gas discharge lamp 10 are part of a controlled system 2 which in turn is part of a control circuit, the performance of which is determined by a controller 1. In particular, the device shown in FIG. 4 is used to control the brightness of the gas discharge lamp 10 as a function of an externally predetermined desired dimming value SOLL which is compared with an actual dimming value IST in a comparator 3 formed as an adder, in which case the resultant differential signal DIFF is fed to the controller 1 which as a function of the system deviation DIFF generates a manipulated-variable value signal STELL for a specific controlled variable of the controlled system 2. In particular, the manipulated-variable value signal can relate to the frequency and/or the pulse duty factor of the switched-mode alternating voltage delivered by the inverter 5. In the case of the electronic ballast shown in FIG. 4, in order to determine the actual brightness value of the gas discharge lamp 10 a resistor 12 is provided that is connected in series with the lower lamp filament of the gas discharge lamp 10. The voltage dropping across the resistor 12 is a direct measure of the lamp current flowing by way of the gas discharge path of the gas discharge lamp 10 and the lamp current in turn is related directly to the degree of dimming or the brightness of the gas discharge lamp 10. Consequently, the actual value of the degree of dimming of the gas discharge lamp 10 can be acquired by determining the voltage dropping across the resistor 12.

The fundamental construction of the ballast shown in FIG. 4 is already known, for example, from DE 40 18 127 A1. It is proposed therein that the actual value of an operating variable of the electronic ballast be acquired, that the differential value between the acquired actual value and a predetermined desired value be formed and that this differential value be fed to a controller which as a function of the differential value generates a manipulated-variable value, for example for the alternating voltage of the inverter applied to the series-resonant circuit, in order, in this way, to control the lamp brightness of the gas discharge lamp activated by way of the series-resonant circuit.

On account of the series-resonant circuit, provided in the controlled system 2 shown in FIG. 4, that has the coil 6 and the capacitor 7, the controlled system 2 manifests in substance a $PT_2$ characteristic (proportional response with second-order delay), i.e. the controlled system acts as a second-order delay element. It is known that controlled systems with a delayed P action require a PI controller in order to guarantee a transient response of the controlled system that is as rapid as possible and to counteract control-circuit instabilities which can develop as a result of an increasing tendency of the controlled system to oscillate. Advantageously, a PID controller is used in this connection, that is, a controller which has properties that both amplify in a proportional manner and also integrate and differentiate. Since, however, the structure of such a PID controller is very complex, for the sake of simplicity as a rule a PI controller is used as the controller 1 for the controlled system 2 shown in FIG. 4.

When the gas discharge lamp 10 is fired, the lamp current detected with the aid of the actual-value signal IST rises in an abrupt manner, whereby a light flash is generated in the gas discharge lamp 10, something which is to be avoided, however. It is therefore recommendable that in the case of a low level of brightness of the gas discharge lamp 10, that is, with a high degree of dimming, a controller 1 be selected, the proportional component of which is so high that it is possible to fire the gas discharge lamp 10 without a light flash even in the case of low brightness values. Such a high proportional component, that is, amplification of the controller 1, in the case of large lamp currents and a high lamp output, that is, with little dimming, would, however, result in instabilities in the control circuit within the controlled system 2 shown in FIG. 4.

A method for controlling the operational performance of gas discharge lamps is already known from DE 43 31 952 A1, wherein a parameter of the controller device used thereby is set as a function of a predetermined desired value. In particular, in accordance with this publication a controller device consisting of two blocks is used, with the one block forming the actual controller and the second block connected downstream of the first block forming a limiter which limits the output signal of the controller to a maximum value. An acquisition circuit arrangement is used to acquire the actual value of the lamp output of the gas discharge lamp and feed it to the controller which, moreover, receives a predetermined desired value and as a function of the difference between the actual value and the desired value generates a manipulated-variable value for the pulse duty factor of a switching controller of the electronic ballast. This manipulated-variable value is fed to the limiter which limits the manipulated-variable value in relation to an adjustable maximum value, in which case the maximum value of the limiter is set as a function of the predetermined desired value. In particular, the maximum value of the limiter is reduced in the case of a low desired value. The use of a controller with a proportional component and the problems connected therewith as previously explained are not, however, known from this publication.

A control method and an electronic ballast respectively are disclosed in EP-A1-0 605 052. A control circuit arrangement compares the lamp current, which occurs in the load circuit of the electronic ballast, with a predeterminable desired value and, as a function of the difference between the actual value of the lamp current and the desired value, generates a regulating signal for the frequency of the inverter. The control circuit arrangement has the control response of a PI controller in order to avoid instabilities. DE-A1-44 12 510 describes an illumination-control circuit arrangement having a feedback loop with a rate of response that can be changed over exclusively during the start-up phase. The rate of response is changed over as a function of the lamp voltage which is correlated with the lighting efficiency of the corresponding gas discharge lamp.

SUMMARY OF THE INVENTION

The underlying object of the present invention is to provide a method and a device for controlling the operational performance of gas discharge lamps with use of a controller with a proportional component, wherein the control can be better adapted to the needs.

In particular, the gas discharge lamps are also to be capable of being fired in a reliable manner in the case of a high degree of dimming, that is, in the case of a low level of lamp brightness, without instabilities occurring in the case of lower degrees of dimming, that is, in the case of greater lamp outputs.

The above-mentioned object is achieved with regard to the method by means of a method for controlling the operational performance of at least one gas discharge lamp, wherein a manipulated-variable value for at least one specific controlled variable is generated with the aid of a controller as a function of a differential value between a predetermined desired value and an actual value of a specific operating parameter of the at least one gas discharge lamp, for the purpose of controlling the brightness of the at least one gas discharge lamp. The controller has a proportional component or amplification factor. The desired value is fed directly to the controller and the value of the proportional component or the amplification factor of the controller is set as a function of the desired value in such a way that the proportional component or amplification factor of the controller is reduced for desired values which correspond to comparatively high brightness values and is increased for desired values which correspond to comparatively low brightness values.

The above-mentioned object is achieved with regard to the device by means of an electronic ballast in combination with a controller device which, as a function of a differential value between a predeterminable desired value and an actual value of an operating parameter of the at least one gas discharge lamp, generates a manipulated-variable value for at least one specific controlled variable for the purpose of controlling the brightness of the at least one gas discharge lamp, in which case the controller device has a proportional component or amplification factor. The ballast also has a controlled system which has a series-resonant circuit and which is also connected thereto the at least one gas discharge lamp. The desired value is fed directly to the controller device. The electronic ballast has setting means for setting the proportional component or the amplification factor of the controller device as a function of the desired value in such a way that the proportional component or amplification factor of the controller is reduced for desired values which correspond to comparatively high brightness values and is increased for desired values which correspond to comparatively low brightness values.

Various advantageous modifications and improvements are also described and claimed herein.

The above-mentioned object is achieved in accordance with the invention in that the desired value predetermined for the control circuit, for example the desired dimming value, is fed directly to the controller in order to adapt the properties of the controller as a function of the desired value. In particular, the proportional component, that is, the amplification factor, of the controller is set and adapted as a function of the desired value. Thus, a high proportional component, that is, a high amplification factor, is required to start gas discharge lamps in the case of low brightness values, that is, high degrees of dimming, in order to be able to fire the gas discharge lamp without a light flash. With a rising level of brightness of the gas discharge lamp, that is, with a decreasing degree of dimming, the proportional component of the controller is reduced and in the extreme case is even set to zero, with the controller operating as a pure I controller in this case. By decreasing the proportional component of the controller in the case of increasing levels of lamp brightness, instabilities of the control circuit are avoided even in the case of high lamp outputs or large lamp currents.

Generally, in accordance with the invention in critical dimming ranges, in which a small proportional component, that is, a low amplification factor, could result in the instability of the control circuit, the proportional component of the controller can be increased in a controlled manner.

Generally, in accordance with the invention the aim is thus to select and set the ideal proportional component in each case for each individual load case which, in addition to being detected and specified with respect to a predetermined desired dimming value, can also be detected and specified with respect to a change in operating-status parameters of the control circuit.

In addition to setting specific operating parameters of the controller, in particular the proportional component of the controller, as a function of the desired value of the control circuit, it is thus also conceivable to set the corresponding operating parameters of the controller as a function of specific actual values of selected operating-status parameters, for example the lamp current or the lamp voltage. In addition to the proportional component of the controller, in accordance with the invention it is also possible to adapt other controller parameters, such as, for example, the integrating component and so on, as a function of the predetermined desired value.

The method and electronic ballast in accordance with the invention can be applied in particular wherever illumination with low levels of brightness, that is, high degrees of dimming, is desired, such as, for example, in cinema auditoria or the like, since in accordance with the invention it is possible to fire gas discharge lamps in a reliable manner without a light flash even in the case of a low degree of brightness.

BRIEF DESCRIPTION OF THE DRAWINGS

The invention is described in the following with reference to the drawing and with the aid of preferred exemplary embodiments.

DETAILED DESCRIPTION OF THE PREFERRED EMBODIMENTS

Figure 1:
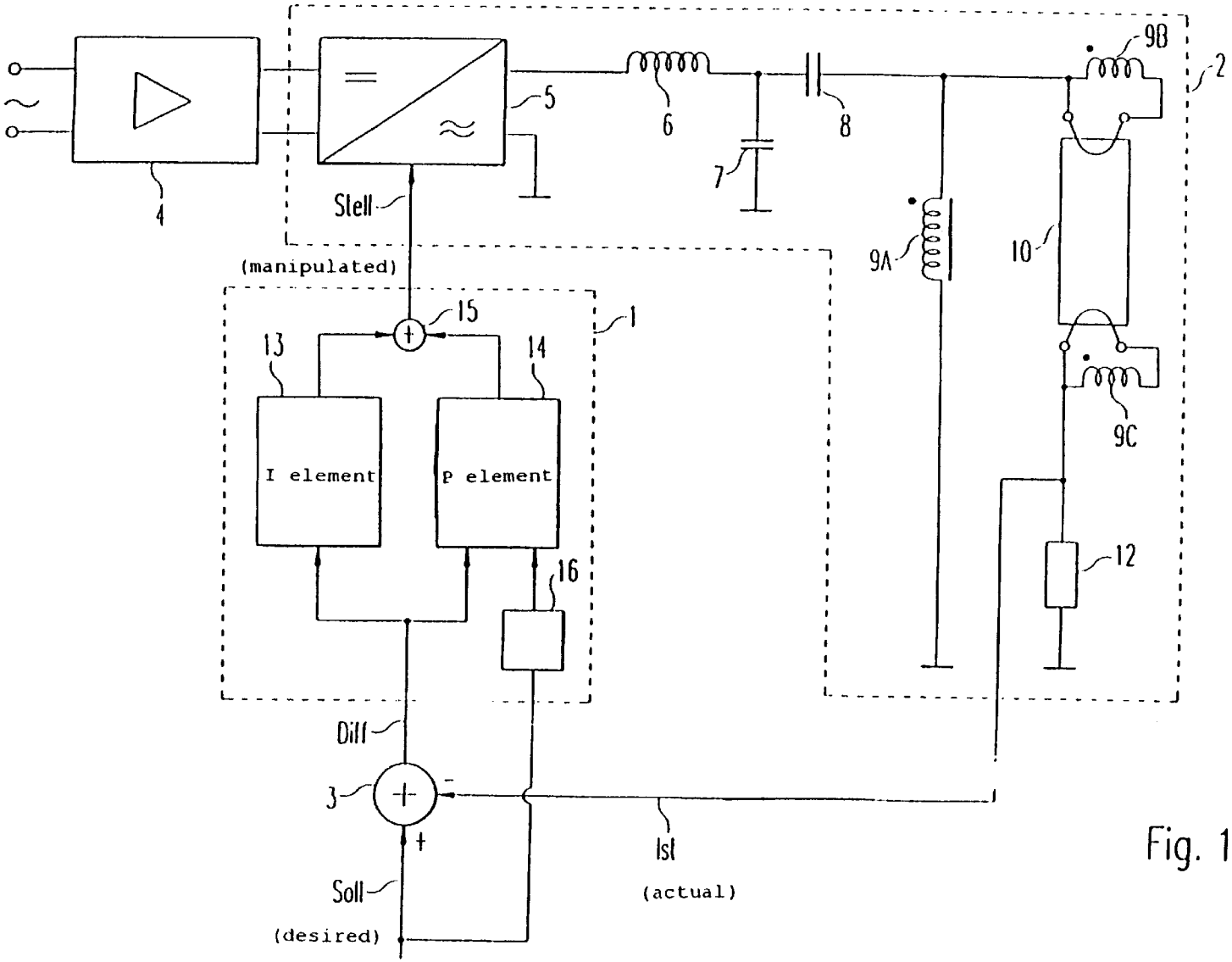
FIG. 1 shows a first exemplary embodiment of the electronic ballast in accordance with the invention.

FIG. 1 shows a first exemplary embodiment of the electronic ballast in accordance with the invention for the purpose of operating gas discharge lamps.

Figure 4:
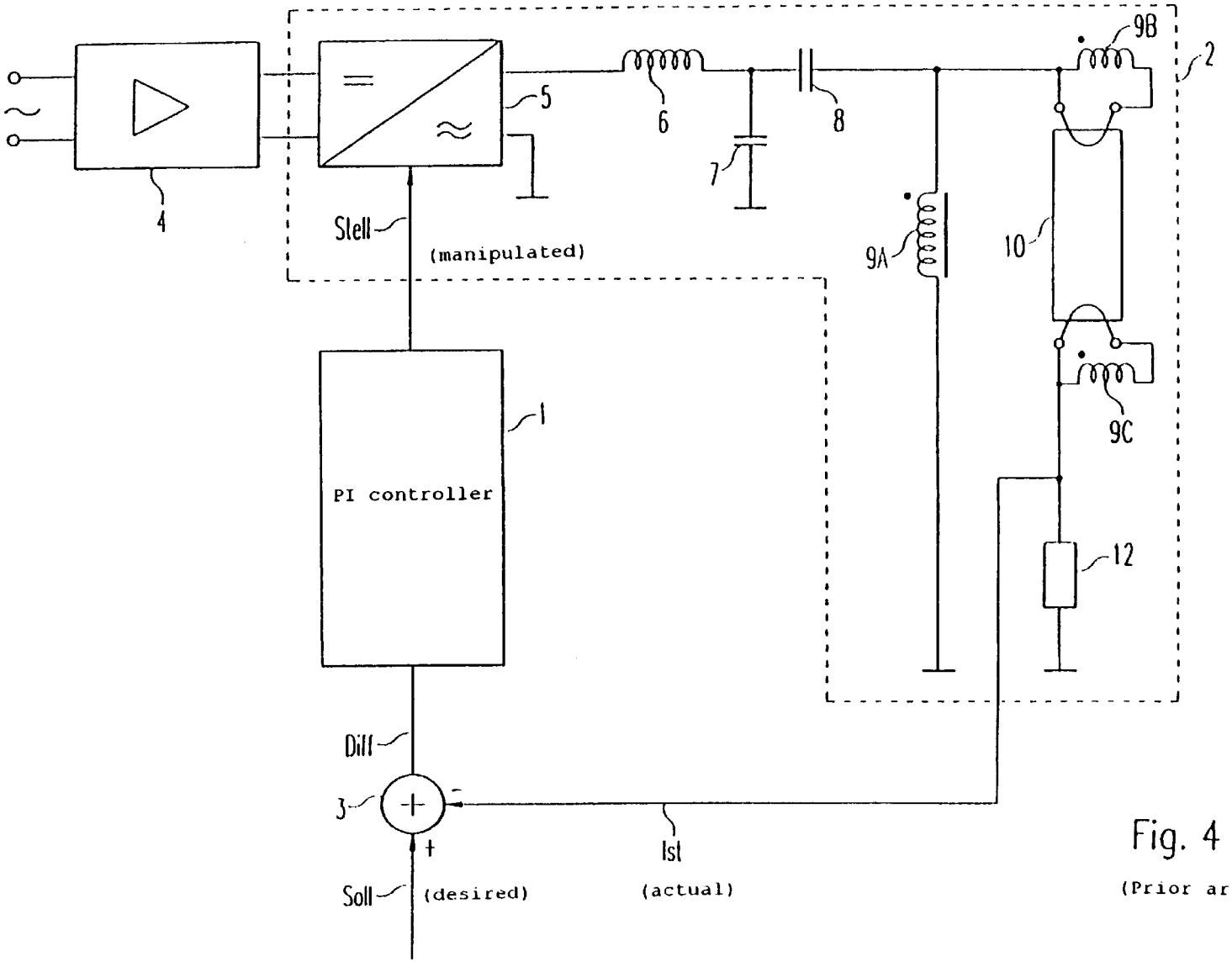
Fig. 4 (Prior art)
FIG. 4 shows a known electronic ballast with a PI controller for the purpose of controlling the operational performance of a gas discharge lamp provided in a controlled system.

The electronic ballast shown in FIG. 1 has—as already explained with the aid of FIG. 4—a control circuit which contains a controller 1, a controlled system 2 and also a comparator 3. Those components that correspond to the components shown in FIG. 4 are provided with identical reference symbols, in which case the description of these components is not repeated.

The exemplary embodiment, shown in FIG. 1, of the electronic ballast in accordance with the invention differs from the known electronic ballast shown in FIG. 4 mainly in terms of the design of the controller 1. Like the controller shown in FIG. 4, the controller 1 used in the case of the electronic ballast in accordance with the invention is also designed as a PI controller which therefore has both a proportionally amplifying and an integrating action. Advantageously, the PI controller 1 can be completed by means of a differential element so that the PI controller becomes a PID controller which, whilst having a more costly structure, is, however, more suitable for the control of the action of the controlled system which manifests a $PT_2$ characteristic.

The invention is explained in the following with reference to the dimming of the gas discharge lamp. It is, however, quite conceivable, in departure from the application to the control of the lamp brightness, to apply the fundamental idea of the invention, namely the adaptation of the operating parameters of the controller as a function of an externally predetermined desired value, to the control of other controlled variables as well.

The externally predetermined desired dimming value can originate from an external dimmer or, for example, even from a light sensor which monitors a specific workplace illuminated by the lamp 10.

In accordance with the invention it is now proposed in particular that the proportional component of the PI controller 1 shown in FIG. 1 be set as a function of the externally predetermined desired dimming value SOLL. To this end, the PI controller 1 has a setting device 16 which could optionally also be arranged outside the PI controller 1. The externally predetermined desired dimming value SOLL is fed to this setting device 16. The setting device 16 sets the proportional component of the PI element 14 of the PI controller 1 as a function of the desired dimming value SOLL. The desired dimming value SOLL is compared with the actual dimming value IST in a comparator 3, with the resultant differential value DIFF being fed to an I element 13 of the PI controller 1 in addition to being fed to the P element 14 thereof. The P-control element 14 and the I-control element 13 in each case as a function of the differential value supplied generate a corresponding manipulated-variable value, in which case the manipulated-variable values thus produced are added on the output side by an adder 15 and output as a manipulated-variable value signal STELL of the PI controller 1.

The acquisition of the actual value of the lamp brightness 10, that is, the degree of dimming, is effected in particular—as already explained with the aid of FIG. 4—by determining the voltage which drops across a resistor 12 connected to earth in series with the lower lamp filament of the gas discharge lamp 10. The voltage dropping across this resistor 12 is a measure of the lamp current that flows by way of the gas discharge path of the gas discharge lamp 10 and which rises with an increasing lamp brightness. Thus by monitoring the voltage dropping across the resistor 12 it is possible to detect the lamp brightness of the gas discharge lamp 10 or its degree of dimming. The P component within the PI controller 1 is set with the aid of the setting device 16 as a function of the predetermined desired dimming value SOLL, as shown in FIG. 2*a* or 2*b*.

In order to be able to guarantee reliable firing of the gas discharge lamp 10 even in the case of low brightness values, that is, with high degrees of dimming, without generating a light flash in the gas discharge lamp 10, in accordance with the invention the selected proportional component within the PI controller for such low brightness values must be great. If, however, this high proportional component or amplification factor were to be maintained even in the case of high brightness values, that is, low degrees of dimming, on account of the high lamp current flowing in the controlled system 2 in this case or the high lamp output, instabilities of the control circuit could result. For this reason, with a rising lamp current, that is, with a rising lamp brightness, the proportional component, that is, the amplification factor of the PI controller 1, is reduced, with the proportional component even being set at zero in the extreme case so that in this case the PI controller 1 acts as a pure I controller. As shown in FIG. 2*a*, it is possible to set the proportional component of the PI controller 1 as a function of the predetermined desired dimming value SOLL in a linear manner. It is, however, also conceivable to set the proportional component as a function of the lamp brightness or the desired dimming value SOLL in steps, as shown in FIG. 2*b*. In each of these cases, the setting device 16 sets the proportional component of the proportional control element 14 in accordance with the characteristic curve shown in FIGS. 2*a* and 2*b* respectively as a function of the desired dimming value SOLL applied to it.

In this way, in accordance with the invention it is possible to select and set the ideal proportional component or amplification factor for each load case, that is, for each dimming value.

Figure 2:
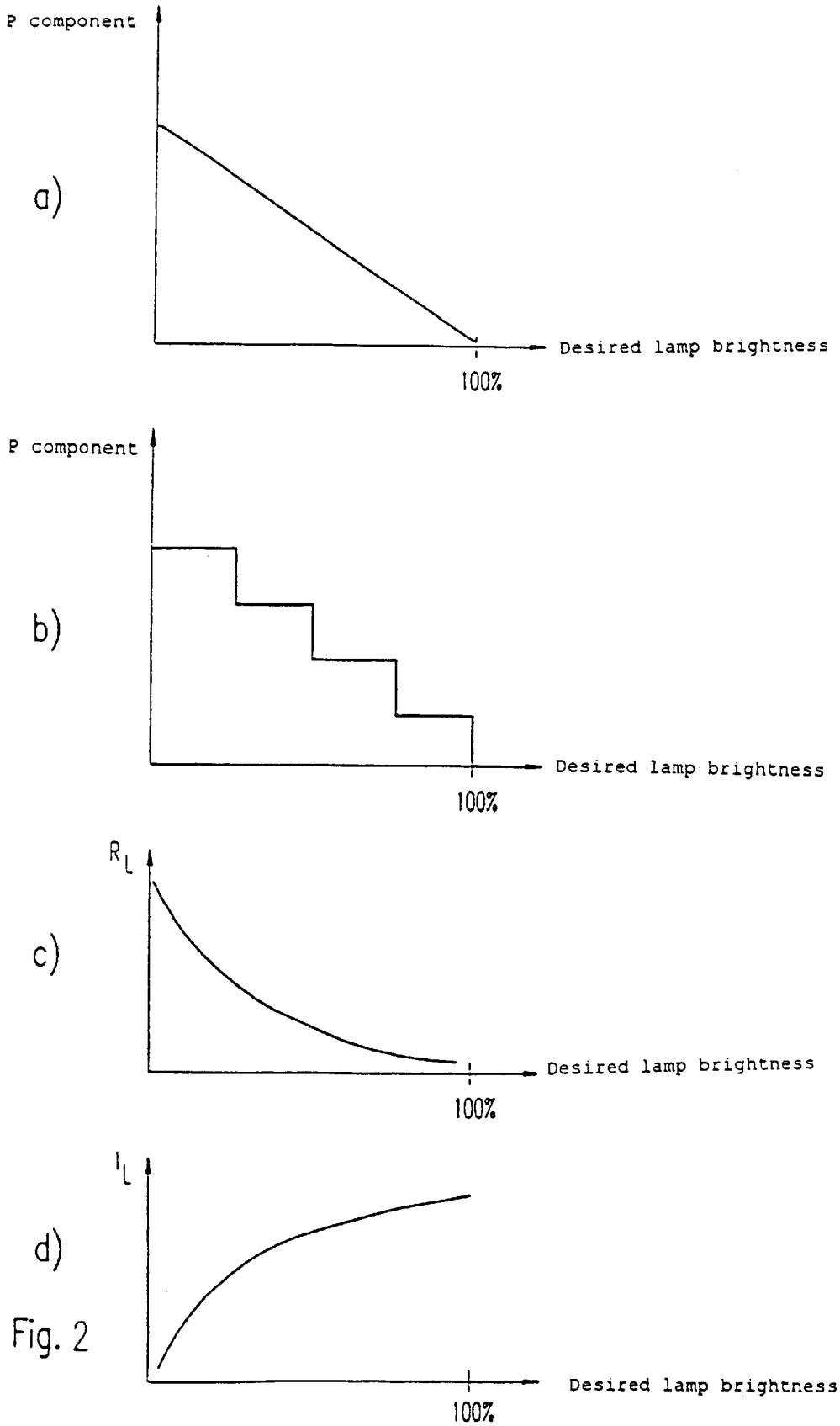
FIGS. 2*a* and 2*b* show shapes of curves for the setting of the proportional component of the controller as a function of the lamp brightness.
FIGS. 2*c* and 2*d* show shapes of curves of the lamp resistance and the lamp current respectively as a function of the lamp brightness.

FIG. 2*c* shows the curve shapes, corresponding to the characteristic curves of FIGS. 2*a* and 2*b*, of the lamp resistance $R_L$ of the lamp current $I_L$, as a function of the lamp brightness of the gas discharge lamp 10 or the given desired dimming value SOLL respectively. It can be seen in particular from FIGS. 2*c* and 2*d* that with an increasing lamp brightness the lamp current over the gas discharge path of the gas discharge lamp 10 rises and accordingly the resistance of the gas discharge lamp falls in like manner with the desired lamp brightness.

Figure 3:
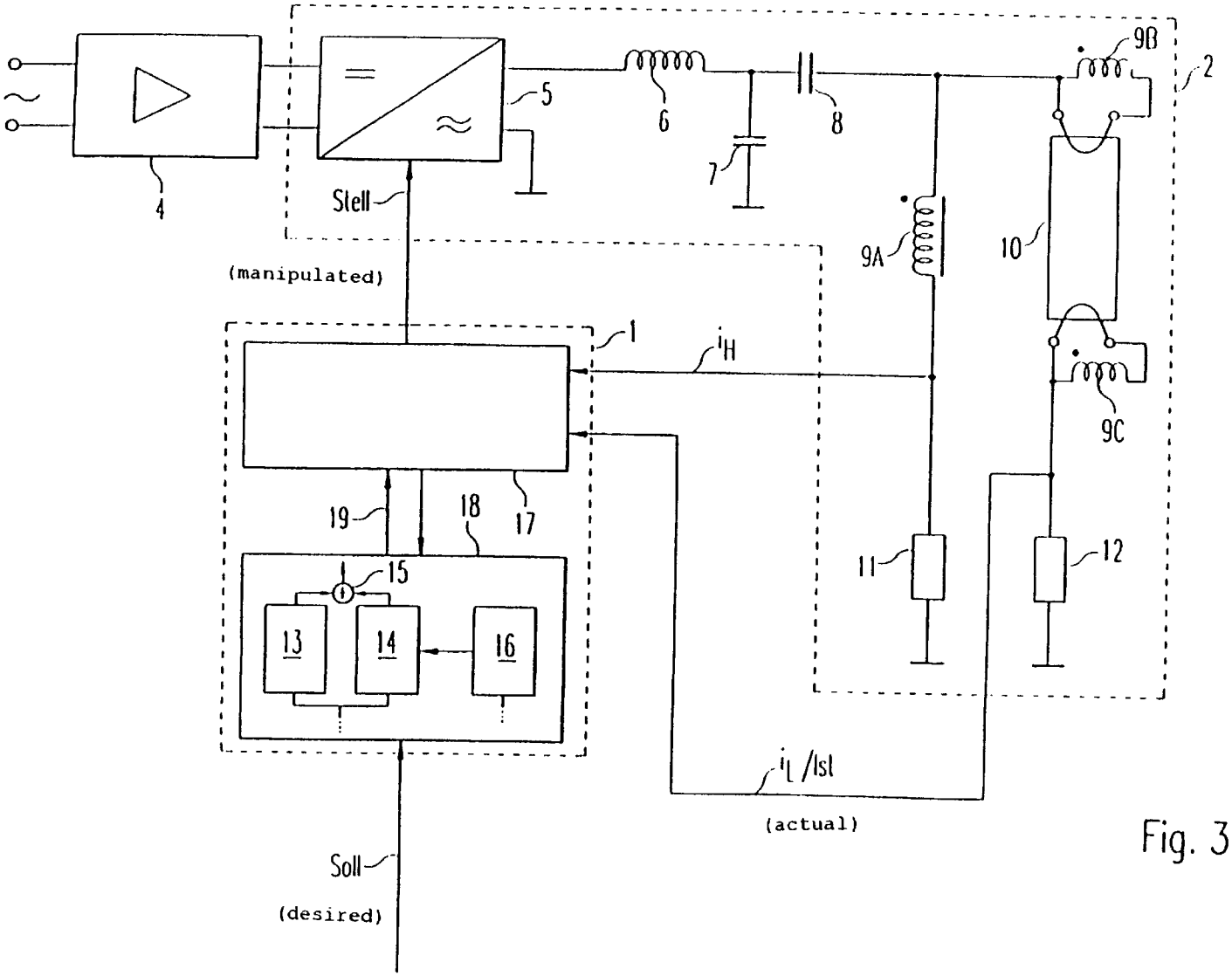
FIG. 3 shows a second exemplary embodiment of the electronic ballast in accordance with the invention.

FIG. 3 shows a second exemplary embodiment of the electronic ballast in accordance with the invention.

In the case of the exemplary embodiment shown in FIG. 3, the PI controller 1 is divided into two control units 17 and 18. The first control unit 18 is controlled purely in terms of software and is provided in particular in the form of a programmable or programmed microprocessor. The second control unit 17 is constructed purely in terms of hardware by means of a combination of known standard circuit arrangements and in particular is designed in the form of an application-specific integrated circuit (ASIC). The two control units 17 and 18 are connected together by means of a bidirectional transmission line 19. The first control unit 18 receives exclusively externally predetermined control information, such as in particular the externally predeterminable desired dimming value SOLL. The second control unit 17, on the other hand, receives exclusively internal operating-status parameters, such as, for example, the lamp current $i_L$, which at the same time is a measure of the degree of dimming or the lamp brightness of the gas discharge lamp 10. Moreover, in accordance with FIG. 3 the second control unit 17 receives the instantaneous value of the filament or heating current $i_H$ which flows by way of the primary winding 9A of the filament-heating transformer. To this end, a resistor 11 is connected between the primary winding 9A of the filament-heating transformer and earth so that the voltage dropping across this resistor 11 is a measure of the filament current $i_H$ flowing by way of the primary winding 9A. Further internal operating-status parameters, such as, for example, the actual values of the lamp voltage or the direct voltage delivered by the rectifier 4, can be fed to the second control unit 17.

The function of the divided PI controller 1 shown in FIG. 3 is as follows. The second control unit 17 receives and stores the actual values of the operating-status parameters applied to it. Thereupon, the first control unit 18 reads out from the corresponding memory of the second control unit 17 the corresponding actual values of the afore-mentioned internal operating-status parameters and as a function of the actual values of the internal operating-status parameters transmitted by way of the connecting line 19 and also the external control information applied to the first control unit 18, in particular the desired dimming value SOLL, determines corresponding manipulated-variable value information. The first control unit 18 thus realizes the actual function of the PI controller 1. In particular, the functions of the setting device 16 of the P element 14, the I element 13 and also the adder 15 are implemented in the first control unit 18. In the first control unit 18 the P component within the PI controller function is thus set as a function of the desired dimming value SOLL applied to said first control unit 18. After the manipulated-variable value information has been generated by means of the first control unit 18, the first control unit 18 transmits this manipulated-variable value information by way of the bidirectional connecting line 19 to the second control unit 17 which in turn on the basis of this manipulated-variable value information generates the proper manipulated-variable value signal and brings about the change in the corresponding controlled variable, for example the frequency or the pulse duty factor of the alternating voltage delivered by the inverter 5.

The division of the PI controller 1 shown in FIG. 3 into a control unit 18 which is controlled purely in terms of software and a control unit 17 which is realized purely in terms of hardware makes it possible, on the one hand on account of the realization of the first control unit 18 in terms of software, to guarantee sufficiently great flexibility for the purposes of adaptation to possible circuit-arrangement changes and, on the other hand with the aid of the second control unit 17 set up as hardware, to ensure that the speed is sufficiently high on account of the latter's design in terms of hardware. The first control unit 18 is thus responsible for the slow control processes and the second control unit 17 is responsible for the rapid control processes. If the PI controller 1 were set up totally and purely as hardware, there would not be sufficient flexibility to enable changes to be made in terms of circuit engineering. On the other hand, the processing speed of the PI controller 1 with a purely software design would not be rapid enough for rapid regulating or control processes. The solution shown in FIG. 3 thus affords the best possible compromise between sufficient flexibility, on the one hand, and a processing speed which is sufficiently high, on the other hand.

What is claimed is:

1. Method for controlling the operational performance of at least one gas discharge lamp wherein a manipulated-variable value for at least one specific controlled variable is generated with the aid of a controller as a function of a differential value between a predetermined desired value and an actual value of a specific operating parameter of the at least one gas discharge lamp, for the purpose of controlling the brightness of the at least one gas discharge lamp, and wherein the controller has a proportional component or amplification factor, said method comprising the steps of:

feeding the desired value directly to the controller; and setting the value of the proportional component or the amplification factor of the controller as a function of the desired value in such a way that the proportional component or amplification factor of the controller is reduced for desired values which correspond to comparatively high brightness values and is increased for desired values which correspond to comparatively low brightness values.

2. Method according to claim 1, wherein:

the setting of the proportional component or the amplification factor of the controller as a function of the desired value is effected in a linear manner or in steps.

3. In combination with an electronic ballast for operating at least one gas discharge lamp;

a controller device which, as a function of a differential value between a predeterminable desired value and an actual value of an operating parameter of the at least one gas discharge lamp, generates a manipulated-variable value for at least one specific controlled variable for the purpose of controlling the brightness of the at least one gas discharge lamp, said controller device having a proportional component or amplification factor; and a controlled system which has a series-resonant circuit connecting the at least one gas discharge lamp thereto;

said controller device being arranged to receive the desired value directly;

said electronic ballast including a setting means for setting the proportional component or the amplification factor of the controller device as a function of the desired value (SOLL) in such a way that the proportional component or amplification factor of the controller is reduced for desired values which correspond to comparatively high brightness values and is increased for desired values which correspond to comparatively low brightness values.

4. A combination according to claim 3, wherein:

the controller device includes the setting means.

5. A combination according to claim 3, further including:

an actual-value acquisition device which is connected and arranged to ascertain the actual value of the brightness of the at least one gas discharge lamp by determining the lamp current or a variable corresponding to the lamp current.

6. A combination according to claim 3, wherein:

the setting means is constructed to set the proportional component or amplification factor of the controller device as a function of the predeterminable desired value in a linear manner.

7. A combination according to claim 3, wherein:

the setting means is constructed to set the proportional component or amplification factor of the controller device as a function of the predeterminable desired value in steps.

8. A combination according to claim 3, wherein:

the controller device has the control response of a PI or PID controller.

9. A combination according to claim 3, wherein:

the controller device comprises a first control unit constructed to be controlled by software, and a second control unit connected thereto and constructed exclusively in terms of hardware, said first control unit being arranged to receive external control information, and said second control unit is arranged to receive internal operating-status information.

10. A combination according to claim 9, wherein:

said first control unit is constructed and arranged to receive the desired value and the second control unit is constructed and arranged to receive the actual value;

wherein the first control unit includes the setting means;

wherein the first control unit is connected to the second control unit by way of a bidirectional connecting line, wherein the first control unit is constructed and arranged to determine the manipulated-variable value information, which corresponds to the manipulated-variable value, as a function of the external control information fed to it with the desired value and the internal operating-status information received from the second control unit by way of the connecting line with the actual value; and wherein the first control unit is constructed to transmit this information to the second control unit which, as a function of this manipulated-variable value information, generates a manipulated-variable value signal for the controlled variable.

11. A combination according to claim 9, wherein:

the first control unit is a programmable microprocessor and the second control unit is an application-specific integrated circuit.

12. A combination according to claim 3, wherein:

the controlled variable relates to the frequency or the pulse duty factor of an alternating operating voltage applied to the series-resonant circuit.

* * * * *